United States Patent [19]

Torgow

[11] Patent Number: 4,477,078

[45] Date of Patent: Oct. 16, 1984

[54] GAME APPARATUS

[76] Inventor: Abraham M. Torgow, 185 E. 206th St., New York, N.Y. 10458

[21] Appl. No.: 222,667

[22] Filed: Jan. 2, 1981

Related U.S. Application Data

[63] Continuation-in-part of Ser. No. 23,730, Mar. 26, 1979, Pat. No. 4,264,073.

[51] Int. Cl.[3] ..... A63F 7/30

[52] U.S. Cl. ..... 273/122 A; 273/127 C; 273/DIG. 26

[58] Field of Search ..... 273/118 A, 119 A, 120 A, 273/121 A, 122 A, 123 A, 124 A, 125 A, 127 C, 142 HA, DIG. 26; 200/61.11

[56] References Cited

U.S. PATENT DOCUMENTS

| | | | |
|---|---|---|---|
| 2,004,190 | 6/1935 | Breitenstein | 273/121 A |
| 2,152,598 | 3/1939 | Mills | 273/118 A |
| 2,283,583 | 5/1942 | Singer | 273/142 HA |
| 2,370,229 | 2/1945 | Buckley | 273/142 HA |
| 3,870,307 | 3/1975 | Meyer et al. | 273/121 A |
| 3,975,019 | 8/1976 | Barlow | 273/121 A |

FOREIGN PATENT DOCUMENTS

| | | | |
|---|---|---|---|
| 2492 | of 1926 | Australia | 273/123 A |
| 17354 | 10/1980 | European Pat. Off. | 273/142 HA |
| 629641 | 2/1960 | Italy | 273/125 A |

*Primary Examiner*—Richard T. Stouffer
*Attorney, Agent, or Firm*—Neophytos Ganiaris

[57] ABSTRACT

A game apparatus consisting of a housing with a game playing surface. A ball is rolled on the playing surface by a conventional shooting device. The playing surface has openings and the ball, propelled from the front towards the rear end, falls into one of the openings, enters into the interior of the housing and rolls back towards the front end. One opening towards the rear end is designated as a "functional" opening and the interior of the housing has electrical wiring and a switching device for starting and stopping a motor which rotates a multi-disc assembly whenever the ball falls into the "functional" opening.

6 Claims, 10 Drawing Figures

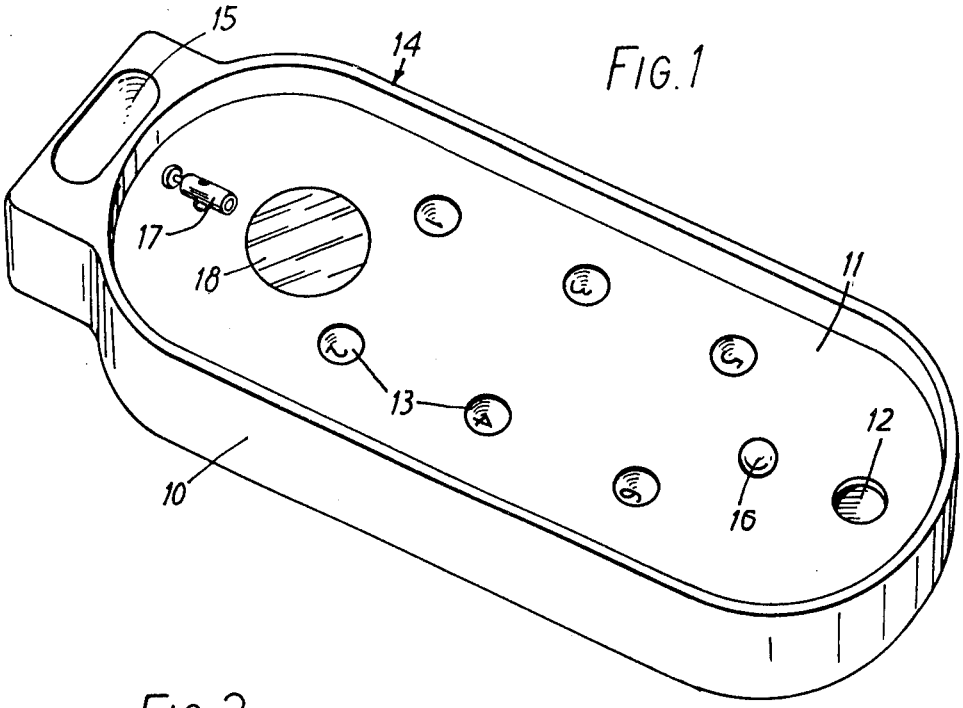
FIG. 1
FIG. 2
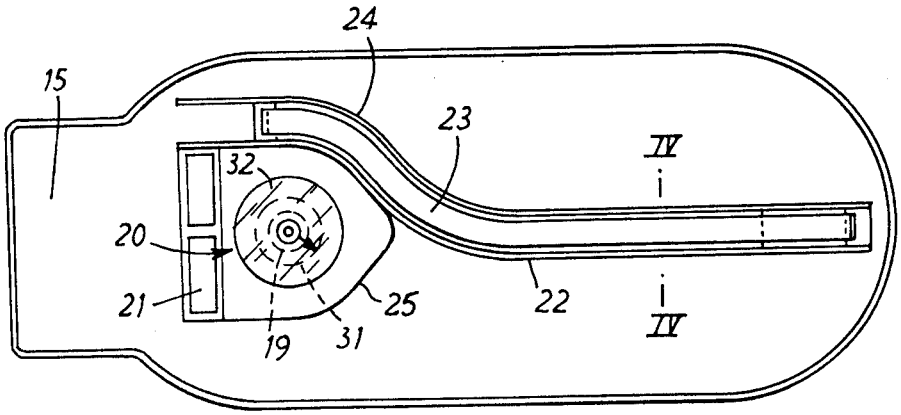
FIG. 3
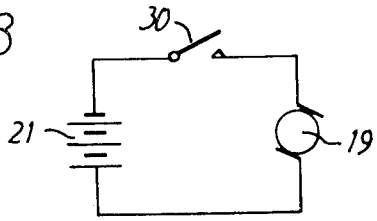

GAME APPARATUS

This application is a continuation-in-part of my copending application Ser. No. 23,730, filed on Mar. 26, 1979, now U.S. Pat. No. 4,264,073.

BACKGROUND OF THE INVENTION

The invention relates to an apparatus for playing a game which combines intellectual decision making and physical skill.

OBJECTS OF THE INVENTION

It is the primary object of the present invention to provide a new game apparatus which comprises a housing with a playing surface, a ball to be rolled on the playing surface, openings to allow the ball to enter the interior of the housing and, in turn, indicate a point score or action to be taken by each player, and means for the ball to roll out of the housing.

Another object of the invention is to provide a switch to be actuated by the ball whenever the ball has passed through one designated opening and, in turn, to energize an electric motor which causes the rotation of a multi-disc assembly.

BRIEF DESCRIPTION OF THE DRAWINGS

In the drawings:

FIG. 1 is a perspective top view of the apparatus of one embodiment of the invention;

FIG. 2 is a plan view of the interior of the apparatus of FIG. 1, showing the electrical wiring, switching means, motor and rotating multi-disc assembly and guiding channels;

FIG. 3 is an electrical wiring diagram for the motor employed in accordance with the invention;

DESCRIPTION OF THE PREFERRED EMBODIMENT

Figure 1A:
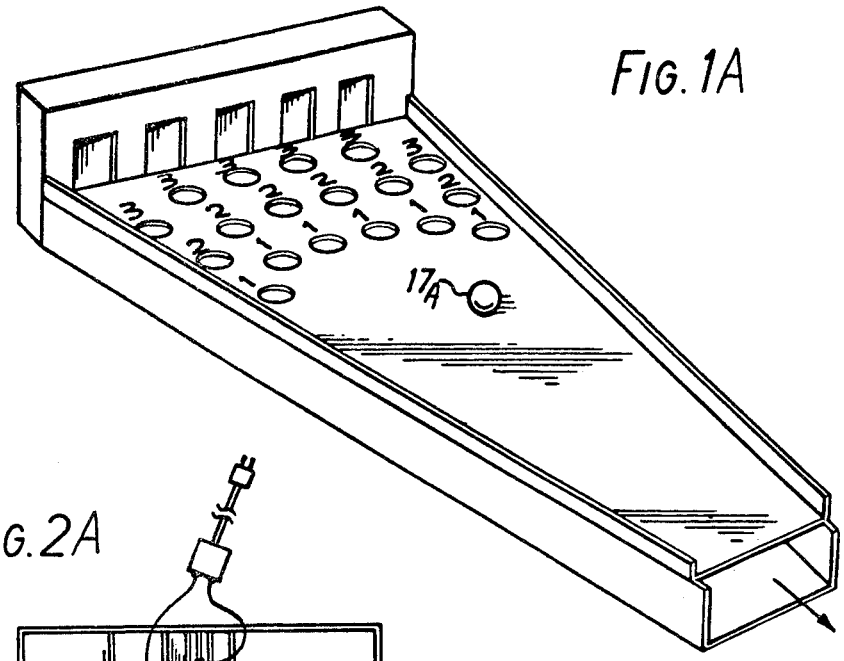
FIG. 1A is a perspective view of the apparatus of another embodiment of the invention.

As shown in FIG. 1 a housing structure 10 has a generally translucent game-playing top surface 11, a circular first opening 12 towards the rear-end of the playing surface which is designated as "functional opening", six numbered second circular openings 13, a side retaining wall 14 projecting above the playing surface 11, a large front-end opening 15 and a transparent circular window 18. A ball 16 is rolled on the playing surface 11 from the front-end towards the openings 12 and 13 by use of a conventional ball projecting device 17. The ball 16 can fall into any one of the opening 12 and 13, enter the interior of the housing and then roll out of the housing through the front end openings 15. The housing 10 can be constructed with a small inclination so that the ball 16 will roll out of the interior of the housing under gravity.

Figure 2A:
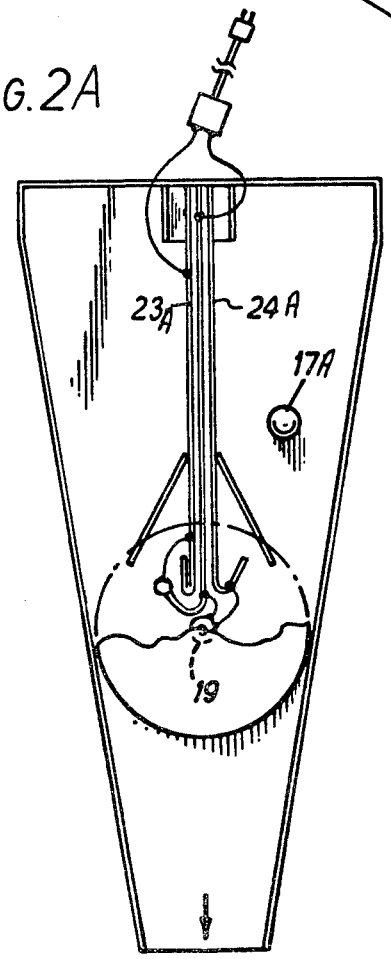
FIG. 2A is a plan view of the interior of the apparatus of FIG. 1A, showing the electrical wiring, switching means, motor and rotating disc, incandescent light bulb and guiding channels.

The size of the openings 12, 13 is related to the size of the ball; for a ball having a half-inch diameter, the circular openings have a diameter of 1–1.5 inches. Also, the openings 13 can have balls cups mounted within them so that the ball 16 is removed manually therefrom. A plan view of the interior of the housing 10 as shown in FIG. 2, indicates that the housing is equipped with a d.c. motor 19 for rotating a multi-disc assembly 20, channel walls 22–24 for guiding the ball 16 to roll on a resilient plastic srrip 23, to act as a movable switch member contact whenever the ball enters the "functional" opening 12 which is shown in FIG. 1.

Figure 3A:
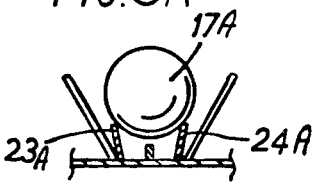
FIG. 3A is an end view of a time switch which may be used with this invention.

The electrical circuit diagram for the d.c. motor 19 is shown in FIG. 3. The switch 30 includes the resilient plastic strip 23 which can be moved by the ball 16. The source of electricity could be a battery 21 as shown in FIG. 3 or several batteries connected together, or any other suitable source of electrical energy with the appropriate electrical wiring to ensure the safety of the players.

Figure 4:
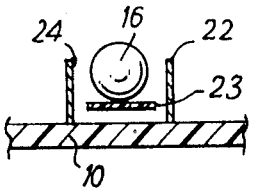
FIG. 4 is a vertical section taken on the line IV—IV of FIG. 2 to show the resilient plastic strip forming part of a switch used with this invention.
Figure 5:
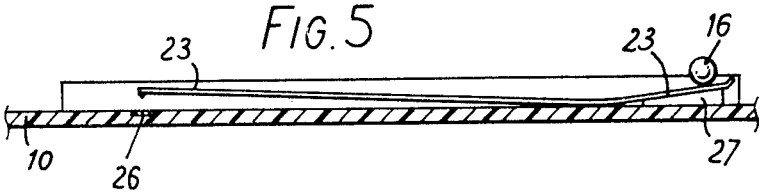
FIG. 5 is a longitudinal section to show mounting of the resilient plastic strip used in the switch.

The ball 16, upon entering the "functional" opening 12, falls into the channel 22–24 and is guided on the resilient plastic strip 23 as shown in FIG. 4. Since the entire game apparatus has a small inclination towards the front-end, the ball will roll in that direction on the plastic strip 23. The plastic strip is fastened on an inclined chute 27, as shown in FIG. 5, at the rear-end of the housing base within the channel 22. The relatively steep inclination of the chute 27 allows the ball to gain momentum and roll towards the front-end freely and quickly; also, the steep inclination of the chute 27 ensures that the ball will roll towards the front-end even if the game apparatus is constructed or positioned without any degree of inclination towards the front-end.

An electrically conductive metal plate 25 having a sharp edge or peak is fastened on the plastic strip 23 at its front-end, and an electrically conductive flat metal plate 26 is positioned under the sharp edge of the plate 25 and fixed on the base of the housing as shown in FIG. 5. The metal plates 25 and 26 are wired into the electrical circuit of the motor 19 to form switch 30 and normally no electric current flows across them when the strip 23 is in raised position. Whenever the ball rolls onto the plastic strip 23, the weight of the ball presses down the front-end of the plastic strip and, thus, closes the electric circuit for the motor 19. As the ball rolls off the plastic strip 23, the strip springs back to its normal raised position and the electric circuit for the motor is broken again.

The switch 30 is closed only for a brief period of time; the time should be sufficiently long (1–2 sec.) to turn on the motor 19 and, in turn spin the multi-disc assembly 20. The time can be adjusted to the desired period by increasing or decreasing the inclination of the game apparatus and/or support 27 for the plastic strip; also, the length and shape of the plastic strip 23 and channel 22, the weight of the ball, and its surface roughness will affect the time period of maintaining a closed circuit for the motor.

Figure 6:
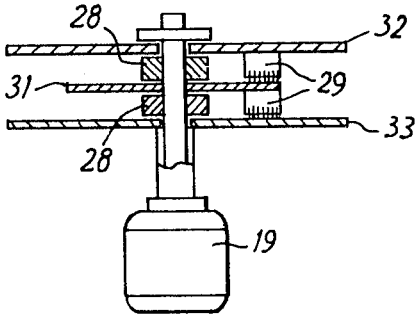
FIG. 6 is an elevation of the multi-disc assembly.
Figure 7:
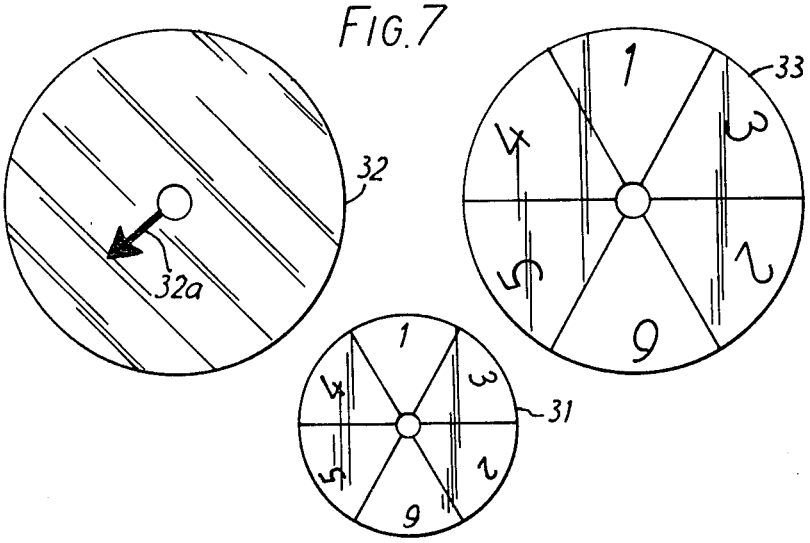
FIG. 7 shows plan views of the three discs of FIG. 6.

The multi-disc assembly 20 consists of three discs as shown in FIG. 6. One disc 31 is fastened to the shaft of the motor 19 and rotates at the speed of the shaft. The other two discs 32 and 33 rotate at random speeds depending on the friction between them and the disc 31 fastened to the motor shaft. The friction between the discs is controlled by the properties of the material used for disc support 28 and the brushes 29 attached to the bottom surface of the disc.

Depending on the rules of the game, the discs 31 and 33 have graduations with various combinations of numbers and shapes. For example, if the rules to be followed by the players are for a dice-game, the discs 31 and 33 will be granduated with numbers from one to six or a dice shape with the appropriate number of dots from one to six. The disc 32 is an indicating disc and is made of a transparent material; the image of an arrow 32*a* is inscribed on its surface and serves as the indicator of the score point or combination of numbers and shapes inscribed on the surfaces of the graduated discs 31 and 33 whenever the multi-disc assembly comes to rest after each spinning.

The indicating disc 32 can be replaced by another stationary pointing device fastened permanently to the housing; also an arrow shape can be inscribed on the transparent window 18 and serve as the indicator of the score point.

The game apparatus of my invention is used in play for a dice-game as follows:

The player aims with the shooting device to introduce the ball into the "functional" opening. If he succeeds, the multi-disc assembly will be spun for 1–2 sec. and, then, come to rest; a combination of numbers (e.g. 3 and 6) will be indicated on the graduated discs. The player, in order to win, must then aim to shoot the next balls into the openings designated by the numerals 3 and 6 as shown on the game playing surface.

The description of the playing of the game has been brief and is merely exemplary. Many rule modifications are possible.

While this invention has been shown and described in the best forms known, it will nevertheless be understood that this is purely exemplary and that modifications may be made without departing from the scope of the invention as defined in the appended claims.

In a second preferred embodiment FIGS. 1A through 3A, the time switch 30 consists of a pair of spaced adjacent elongated parallel electrical conductors 23A and 24A adapted to be bridged electrically by an electrically conductive ball 17A.

I claim:

1. Apparatus, for playing a game, comprising:

(i) an elongated structure with an upper wall extending in the direction from a first end to a second end and forming a top playing surface, said upper wall having therein at least one first opening and a plurality of second openings all dimensioned to permit passage of a ball rolled along said playing surface, and an upstanding wall bounding said top playing surface at least at said second end, (ii) an elongated ball guiding means disposed below said playing surface and extending towards said first end, said guiding means including a chute portion positioned below said at least one opening and inclined to cause a ball, dropping onto said chute portion, to roll therealong towards said first end, said ball guiding means including a ball support which is resiliently urged to raised position, said support being adapted to be moved downwardly to a lowered position by the weight of a ball received thereon, said ball support being elongated and extending along a major portion of the length of said chute portion such that when a ball is received on said support it is moved to lowered position for a period of time determined by the ball rolling along the support and passing off an end thereof, (iii) switch means associated with said ball support and arranged to be open when said ball support is not in lowered position, and to be closed when said ball support is not in raised position, (iv) an indicator coupled for actuation by an electric powered device, said indicator including indicator rotor elements rotatable about a common axis and frictionally drivable one from another, (v) electrical wiring connecting said switch means and said electric powered device and terminals for connection to a current source such that a current circuit is completed to said electric powered device when said switch means is closed by the presence of a ball rolling on said support.

2. Apparatus, as claimed in claim 1, wherein said ball support is resiliently deformable.

3. Apparatus, as claimed in claim 1, wherein said top playing surface includes a transparent window portion, and wherein said indicator is positioned below said window portion.

4. Apparatus, as claimed in claim 1, wherein said indicator comprises a first rotor element rotatable about an axis, at least one second rotor element rotatable about said axis, at least two of said rotor elements having angularly spaced markings, frictional slipping drive means acting between said first rotor element and said at least one second rotor element, and an index adjacent said marked rotor elements for indicating respective markings which become aligned therewith.

5. Apparatus, as claimed in claim 4, wherein said index is on a said rotor element.

6. Apparatus, for playing a game, comprising:

(i) an elongated structure with an upper wall extending in the direction from a first end to a second end and forming a top playing surface, said top playing surface including a window portion, said upper wall having therein at least one first opening and a plurality of second openings all dimensioned to permit passage of a ball rolled along said playing surface, and an upstanding wall bounding said top playing surface at least at said second end, (ii) an elongated ball guiding means disposed below said playing surface and extending towards said first end, said guiding means including a chute portion positioned below said at least one opening and inclined to cause a ball, dropping onto said chute portion, to roll therealong towards said first end, said ball guiding means including a resiliently deformable ball support which is resiliently urged to raised position. said support being adapted to be moved downwardly to a lowered position by the weight of a ball received thereon, said ball support being elongated and extending along a major portion of the length of said chute portion such that when a ball is received on said support it is moved to a lowered position for a period of time determined by the ball rolling along the support and passing off an end thereof;

(iii) switch means associated with the ball support and arranged to be open when said ball support is not in lowered position, and to be closed when said ball support is not in raised position, (iv) an indicator positioned below said window portion and coupled for actuation by an electric powered device, said indicator comprising a first rotor element rotatable about an axis, at least one second rotor element rotatable about said axis, at least two of said rotor elements having angularly spaced markings, frictional slipping drive means acting between said first rotor element and said at least one second rotor element, and an index marked on a said second rotor element for indicating respective markings which become aligned therewith, and (v) electrical wiring connecting said switch means and said electric powered device and terminals for connection to a current source such that a current circuit is completed to said electric powered device when said switch means is closed by the presence of a ball rolling on said support.

* * * * *